US009180473B2

(12) United States Patent
Croibier et al.

(10) Patent No.: US 9,180,473 B2
(45) Date of Patent: Nov. 10, 2015

(54) FLUID DISPENSER HEAD

(71) Applicant: APTAR FRANCE SAS, Le Neubourg (FR)

(72) Inventors: Denis Croibier, Berou la Nulotiere (FR); Jean-Jacques Ligny, Le Pecq (FR); Celine Raphanel, Pullay (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 14/134,764

(22) Filed: Dec. 19, 2013

(65) Prior Publication Data

US 2014/0175128 A1 Jun. 26, 2014

Related U.S. Application Data

(60) Provisional application No. 61/759,760, filed on Feb. 1, 2013.

(30) Foreign Application Priority Data

Dec. 20, 2012 (FR) ..... 12 62506

(51) Int. Cl.
*B65D 88/54* (2006.01)
*B05B 11/00* (2006.01)
*B65D 83/42* (2006.01)

(52) U.S. Cl.
CPC ..... *B05B 11/0097* (2013.01); *B05B 11/0056* (2013.01); *B65D 83/42* (2013.01)

(58) Field of Classification Search
CPC . B05B 11/0097; B05B 11/0056; B65D 83/42
USPC ..... 222/321.1, 321.6–321.9, 383.1, 383.3
See application file for complete search history.

(56) References Cited

U.S. PATENT DOCUMENTS

| | | | | |
|---|---|---|---|---|
| 4,437,582 | A | 3/1984 | Dorner | |
| 4,842,495 | A * | 6/1989 | Howlett | 417/488 |
| 5,085,350 | A * | 2/1992 | Sugita | 222/260 |
| 5,102,018 | A * | 4/1992 | Desazars de Montgailhard et al. | 222/321.9 |
| 5,417,258 | A * | 5/1995 | Privas | 141/18 |
| 2001/0011562 | A1 * | 8/2001 | Bailly | 141/2 |
| 2012/0312842 | A1 * | 12/2012 | Dumont et al. | 222/321.9 |
| 2013/0019991 | A1 * | 1/2013 | Muller | 141/18 |

FOREIGN PATENT DOCUMENTS

| | | |
|---|---|---|
| FR | 2 162 893 A5 | 7/1973 |
| GB | 1 407 273 A | 9/1975 |

OTHER PUBLICATIONS

French Search Report for FR 12 62506 dated Jun. 19, 2013.
Written Opinion for FR 12 62506 dated Dec. 20, 2012.

* cited by examiner

*Primary Examiner* — Donnell Long
(74) *Attorney, Agent, or Firm* — Sughrue Mion, PLLC

(57) ABSTRACT

A fluid dispenser head, such as a pusher, includes an inlet duct, and a dispenser orifice in dispensing communication with the inlet duct. The dispenser head further includes diversion means for selectively interrupting dispensing communication between the inlet duct and the dispenser orifice, and for establishing filling communication with a filling duct formed by the dispenser head and exiting outside the dispenser head.

19 Claims, 3 Drawing Sheets

FLUID DISPENSER HEAD

CROSS REFERENCE TO RELATED APPLICATION

This application claims the benefit under 35 U.S.C. §119 (e) of U.S. provisional patent application Ser. No. 61/759,760, filed Feb. 1, 2013, and priority under 35 U.S.C. §119(a)-(d) of French patent application No. FR-12.62506, filed Dec. 20, 2012.

TECHNICAL FIELD

The present invention relates to a fluid dispenser head, such as a pusher, including an inlet duct, and a dispenser orifice in dispensing communication with the inlet duct. This type of dispenser head is frequently mounted on the actuator rod of a pump or a valve that is itself mounted on a reservoir so as to constitute, in this way, a fluid dispenser. Advantageous fields of application of the present invention are the fields of perfumery, cosmetics, and pharmacy.

BACKGROUND OF THE INVENTION

In the field of refillable dispensers, that have more recently become known under the name "travel" dispensers, the reservoir of the refillable dispenser is often provided with a filling valve through which fluid coming from a source dispenser is inserted into the reservoir so as to fill it. In general, the source dispenser is a conventional dispenser having a reservoir that presents a capacity that is much greater than the capacity of the refillable or travel dispenser. In general, the source dispenser includes a pump that is provided with an actuator rod that is axially movable down and up. In order to make it possible to fill the refillable dispenser, it is necessary to perform a prior operation of removing or pulling off the pusher from the source dispenser in order to access the free end of the actuator rod of the pump that is fitted to the source dispenser. From there, the user may press the free end of the actuator rod against the inlet of the filling valve of the refillable dispenser, and may depress the actuator rod of the source dispenser so as to dispense a dose of fluid through the actuator rod and the filling valve that is forced into its open state. This operation may be repeated several times until the reservoir of the refillable dispenser is full once again. It thus suffices for the user to put the pusher back into place on the actuator rod of the source dispenser.

However, the operations of removing the pusher and of putting it back into place on the free end of the actuator rod can cause various difficulties. Removing or pulling off the pusher requires traction that is completely axial in order to avoid damaging the pusher, the actuator rod, or even internal component elements of the pump. Very often, the user tends to pull the pusher sideways, which causes the actuator rod to bend. This can damage the pump. Then, once the pusher has been removed from the actuator rod, it may be misplaced or lost. Finally, the operation of putting the pusher back into place on the actuator rod requires pressure to be applied that is completely axial in order to avoid damaging either the pusher or the actuator rod, as in the above-mentioned removal operation. As a result, it is also possible to damage the pump during the operation of putting the pusher back into place. Furthermore, it is not possible to put the pusher back into place on the actuator rod without depressing it, thereby causing unwanted fluid to be dispensed, and that may consequently be troublesome. In addition, repeated operations of removing the pusher and of putting it back into place on the actuator rod naturally cause wear and fatigue of the parts that may cause the pump to be damaged.

In the prior art, attempts have already been made, without success, to apply the dispenser orifice of the pusher of the source dispenser against the inlet of the filling valve of the refillable dispenser. It can easily be understood that this operation is not convenient, in particular as a result of the axis of the dispenser orifice of the pusher being, in the vast majority of configurations, perpendicular to the axis along which the actuator rod of the pump of the source dispenser moves. It is thus necessary simultaneously to press the dispenser orifice of the pusher against the filling valve and to move the pusher perpendicularly: that requires great dexterity.

BRIEF SUMMARY OF THE INVENTION

An object of the present invention is to remedy the above-mentioned drawbacks of the prior art by defining a fluid dispenser head, such as a pusher, that may be mounted on the actuator rod of a pump of a source dispenser so as to fill a refillable or travel dispenser. The dispenser head of the invention should make it possible to fill the reservoir of the refillable dispenser through its filling valve, but without removing the head of the actuator rod of the pump of the source dispenser, and without using the dispenser orifice of the pusher.

To do this, the present invention proposes that the dispenser head includes diversion means for selectively interrupting dispensing communication between the inlet duct and the dispenser orifice, and for establishing filling communication with a filling duct formed by the dispenser head and exiting outside the dispenser head. In other words, the diversion means make it possible to divert the path of the fluid away from the dispenser orifice and towards the filling duct that is for putting into contact with the inlet of a filling valve of a refillable or travel dispenser.

Advantageously, the inlet duct is accessible from a bottom face of the head, the filling duct opens out on a top face of the head, remote from the inlet duct, and the dispenser orifice advantageously opens out on a side face of the head. Thus, when the filling duct is pressed against the filling valve of a refillable dispenser, the actuator rod of the pump of the source dispenser is depressed and a dose of fluid is dispensed through the inlet duct and the filling duct, the path towards the dispenser orifice being interrupted. It should be observed that a dispenser head with an inlet duct oriented downwards and with a dispenser orifice opening out sideways corresponds to the structure of a conventional pusher in the fields of perfumery, cosmetics, and pharmacy. The user presses on the top face of the dispenser head with one or more fingers so as to exert an axial force, so as to move the dispenser head and thus depress the actuator rod of the pump of the source dispenser. The filling duct of the invention thus extends in the same axis as the inlet duct and the actuator rod of the pump. It is thus easy to apply the filling duct against a filling valve of a travel dispenser, and to exert a force that is sufficient to actuate the actuator rod of the pump of the source dispenser.

In a practical embodiment, the head includes an outlet channel upstream from the dispenser orifice, and a connection chamber that connects the inlet duct to the outlet channel, the diversion means comprising a movable member that is arranged in the connection chamber for selectively closing the outlet channel. Advantageously, the filling duct connects the connection chamber to the outside. Preferably, the movable member selectively closes the filling duct. This last characteristic is optional, given that it suffices to close the outlet of the filling duct, e.g. by means of a cover, such that the filling duct is thus in the form of a blind borehole. In other words, it suffices for the movable member of the diversion means to close the outlet channel that leads to the dispenser orifice so as to redirect or divert the flow of fluid under pressure coming from the inlet duct, towards the filling duct, and beyond that through the filling valve and into the reservoir of a refillable or travel dispenser.

In a practical embodiment, the movable member is axially movable. Advantageously, the movable member includes a channel lip for selectively closing the outlet channel, and forms the filling duct that is engaged on a spike is suitable for closing it selectively. The movable member may thus be in the form of a rigid part that is axially movable in translation against a return spring. In the rest position, the outlet channel is opened and the spike closes the inlet of the filling duct, and in the depressed position, the outlet channel is closed and the inlet of the filling duct is opened.

In a variant embodiment, the movable member is elastically deformable. Advantageously, the filling duct is radially deformable. The movable member may thus be in the form of a deformable stopper that may be driven in axially in such a manner as to generate radial deformation, making it possible to open the inlet of the filling duct and to close the inlet of the outlet channel.

In another practical embodiment, the movable member is movable in turning. Advantageously, the movable member comprises a turnable actuator ring that is accessible on a side face of the head. The movable member is thus in the form of a turnable part that makes it possible to close and open the inlet of the outlet channel leading to the dispenser orifice.

In another advantageous aspect of the invention, the filling duct opens out to the outside at a projecting connection stud for coming into contact with a filling valve of a refillable dispenser. By way of example, the connection stud may be inserted into an appropriate housing that is arranged at the inlet of the filling valve of the refillable dispenser. Advantageously, the head may further include a cover for closing the filling duct from the outside. The cover may be connected to the body of the pusher or to the movable member.

The present invention also defines a dispenser assembly comprising:

a source dispenser including a fluid reservoir on which there is mounted a dispenser member, such as a pump, provided with a dispenser head as defined above; and a refillable dispenser including a filling valve;

the filling duct being pressed against the filling valve in such a manner as to actuate the dispenser member of the source dispenser and to open the filling valve, such that the fluid coming from the source dispenser is transferred into the refillable dispenser.

A principle of the present invention is to provide a dispenser head with a filling duct that is dedicated to connecting to a filling valve of a refillable or travel dispenser. Another principle is to divert the flow of fluid that arrives under pressure in the inlet duct, and that is normally for directing towards the dispenser orifice, towards a filling duct that is adapted to connect to a filling valve of a travel dispenser. The dispenser head may thus be fitted on a conventional dispenser that forms part of a range that also incorporates a refillable dispenser. Still more generally, the dispenser head of the present invention could replace any conventional dispenser head, even if the dispenser is not for forming part of a range that incorporates a refillable dispenser.

BRIEF DESCRIPTION OF THE DRAWINGS

The invention is described more fully below with reference to the accompanying drawings which show three embodiments of the invention by way of non-limiting example.

In the figures.

DETAILED DESCRIPTION

In the three embodiments shown in the figures, the dispenser head T, T', and T" of the invention forms an integral part of a fluid dispenser S that may be entirely conventional. The dispenser S, that may be referred to as a source dispenser, comprises a fluid reservoir S1 that defines a neck S2 inside which there is fastened a dispenser member S3 that is provided with an actuator rod S5. A fastener ring S4 makes it possible to fasten the dispenser member S3 in the neck S2 of the reservoir S1. The dispenser member S3 may be a conventional pump or valve that is not described in detail below. The actuator rod S5 is of an entirely conventional type and defines an internal delivery channel that communicates, in selective manner, with a fluid chamber through an outlet valve. The actuator rod S5 is axially movable down and up against a return spring. The dispenser heads T, T', and T" of the three embodiments of the invention are mounted, in conventional manner, on the free end of the actuator rod S5. The dispenser heads may also be referred to as pushers or pushbuttons on which the user may exert axial pressure, so as to move the actuator rod S5 down and up. This operation is entirely conventional for a fluid dispenser in the fields of perfumery, cosmetics, and pharmacy.

Figure 1:
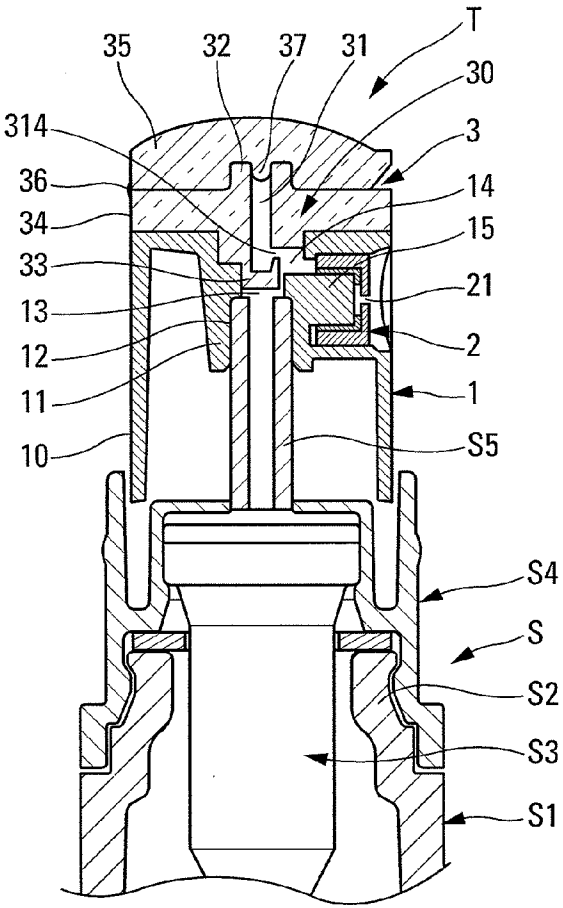
FIG. 1 is a vertical section view through a dispenser including a dispenser head in a first embodiment of the invention, in its normal state of use.

Reference is made below to FIG. 1 in order to describe in detail the structure of the dispenser head T in the first embodiment of the invention. The head T comprises three distinct component elements, namely a body 1, a nozzle 2, and a cap 3. The three parts may be made by injection molding an appropriate plastics material. They are preferably made as a single piece.

The body 1 includes an outer skirt 10 inside which there extends a connection sleeve 11 that internally defines an inlet duct 12. The sleeve 11 and its duct 12 are accessible from the bottom face of the head T that is oriented towards the dispenser member S3. The free top end of the actuator rod S5 is force-fitted inside the connection sleeve 12. Beyond the inlet duct 12, the body defines a chamber 13 that communicates sideways with an outlet channel 14 that leads to the nozzle 2 that is force-fitted on a tenon 15 of the body. The nozzle 2 forms a dispenser orifice 21 via which the fluid is dispensed, e.g. in the form of spray. The dispenser orifice 21 opens out on the side face of the head T. This characteristic is entirely conventional for a spray pusher. The cap 3 is mounted in turnable manner on the body 1 to turn about an axis that coincides with the axis of the actuator rod S5. The cap 3 essentially comprises a movable member 30 and a cover 35 that are connected together by a hinge 36. The movable member 30 defines a filling duct 31 that advantageously extends in alignment with the actuator rod S5. At its top end, the filling duct 31 is bordered by a projecting connection stud 32 having a function that is explained below. The cover 35 advantageously includes a pin 37 that is adapted to be inserted in leaktight manner in the connection stud 32 so as to close the outlet of the filling duct 31. At its bottom end, the filling duct 31 is blind: it is closed by a projecting appendage 33 that is arranged in the connection chamber 13. However, the filling duct 31 is provided with a side opening 314 that puts the inside of the duct 31 into communication with the connection chamber 13 and with the outlet channel 14 that leads to the dispenser orifice 21. The movable member 30 also includes a turnable actuator ring 34 that advantageously extends upwards in register with the skirt 10 of the body 1.

In the configuration shown in FIG. 1, it is possible to press axially by means of a finger on the cover 35 that forms the top face of the head. Fluid is then delivered through the actuator rod S5. In the head, dispensing communication is established between the inlet duct 12 and the outlet channel 14 through the connection chamber 13. Some fluid may indeed penetrate into the filling duct through the side opening 314, but it cannot escape therefrom, since the top end of the duct 31 is closed in leaktight manner by the closure pin 37 of the cover 35. Thus, the fluid under pressure that is delivered through the actuator rod S5 flows through the connection chamber 13 and the outlet channel 14 so as to reach the dispenser orifice 21 from where it is dispensed, e.g. in the form of spray. The FIG. 1 dispenser head T may thus be used in conventional manner, given that the filling duct 31 is completely without effect.

Figure 2:
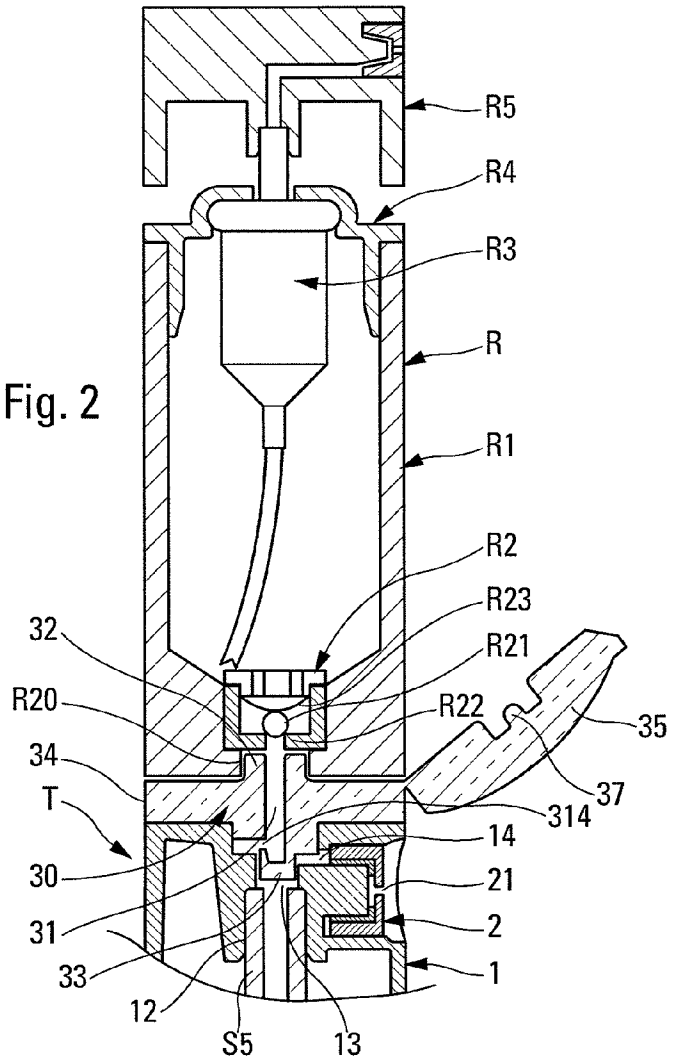
FIG. 2 is a view of the FIG. 1 dispenser head in its state for filling a refillable dispenser.

In FIG. 2, it should immediately be observed that the cover 35 is open and that the movable member 30 has been turned through 180°. Such turning could be performed by holding the movable member 30 by its turnable actuator ring 34. The connection stud 32 thus points upwards: the filling duct 31 is accessible from the top face of the head. In this "filling" configuration, the projecting appendage 33 is now arranged in such a manner as to close the inlet of the outlet channel 14. In contrast, filling communication is still established between the actuator rod S5 and the flow duct 31 through the connection chamber 13 and the side opening 314. By pressing on the movable member 30, the actuator rod S5 is depressed and fluid under pressure is delivered through the actuator rod, the chamber 13, the opening 314, and the filling duct 31.

In FIG. 2, a refillable dispenser R is mounted on the movable member 30 of the head T. In conventional manner, the refillable or travel dispenser R comprises: a fluid reservoir R1; a filling valve R2; a dispenser member R3, such as a pump or a valve; a fastener ring R4 that holds the dispenser member R3 in stationary and leaktight manner on the reservoir R1; and a pusher R5 that is mounted on the actuator rod of the dispenser member R3. By way of example, the filling valve R2 may comprise a movable member R21 in the form of a ball that is urged against a seat R22 by resilient means R23, e.g. in the form of a resilient blade. The filling valve R2 forms a reception housing R20 in which the connection stud 32 of the filling duct 31 may be received in leaktight manner. Thus, by pressing the refillable dispenser R against the movable member 30 with sufficient force, the actuator rod S5 is depressed and fluid under pressure is delivered through the rod S5, the connection chamber 13, the side opening 314, the filling duct 31, and the filling valve R2 that is forced into its open state, such that the fluid may reach the reservoir R1 of the refillable dispenser R. Given that the filling duct 31 is aligned on the same axis as the actuator rod S5, it suffices to push the two dispensers axially towards each other in order to actuate the dispenser member S3 of the source dispenser S. It is not possible to dispense any fluid through the dispenser orifice 21, given that the projecting appendage 33 closes or interrupts dispensing communication between the connection chamber 13 and the outlet channel 14 that leads to the dispenser orifice 21.

Figure 4:
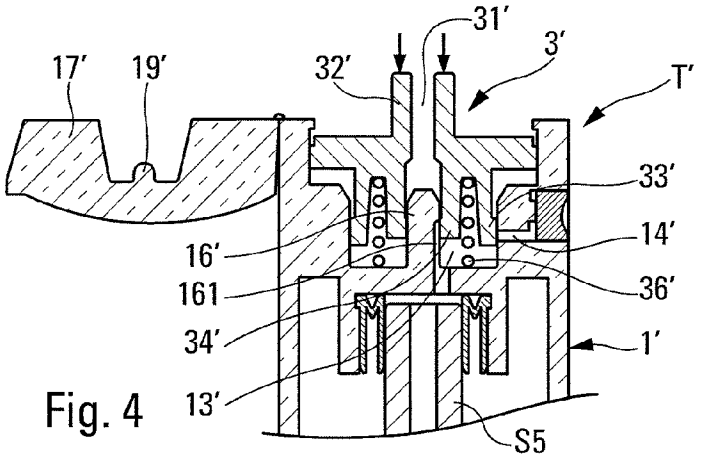
FIG. 4 is a view of the FIG. 3 dispenser head in the filling state.
Figure 5:
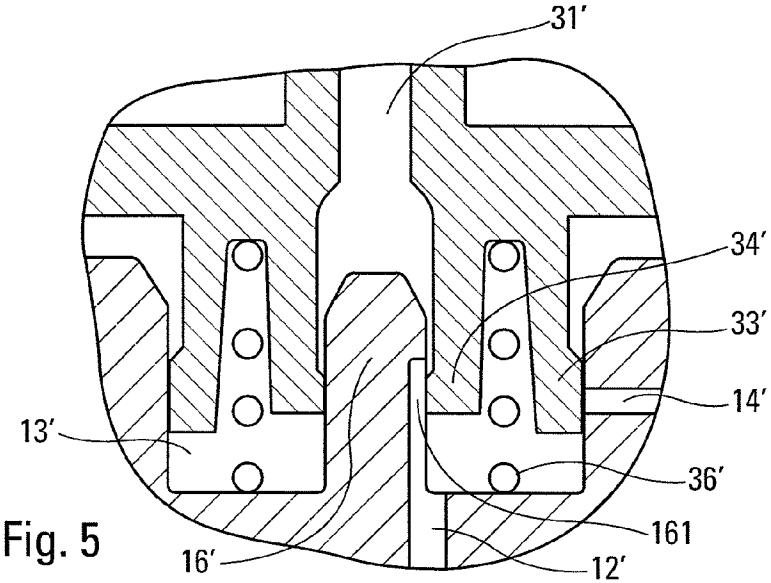
FIG. 5 is a greatly enlarged view of a detail of FIG. 4.
Figure 3:
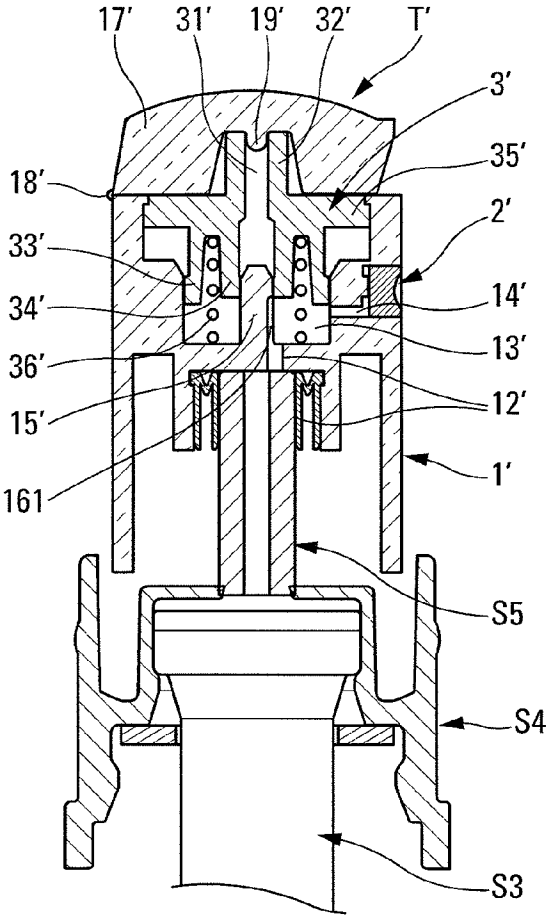
FIG. 3 is a view similar to the view in FIG. 1 in a second embodiment of the invention.

Reference is made below to FIGS. 3, 4, and 5 in order to describe the second embodiment of a dispenser head T' of the invention. The head T' comprises a body 1', a nozzle 2', and a slider 3'.

On the bottom face of the head, the body 1' also defines an inlet duct 12' that leads to a connection chamber 13' from which there stems an outlet channel 14' that connects to the nozzle 2' that forms a side dispenser orifice. A spike 16' extends upwards in axial and central manner inside the connection chamber 13'. The spike 16' includes one or more grooves 161 that are recessed in the side wall of the spike 16'. By way of example, one of the grooves 161 extends upwards in register with the inlet duct 12'. The grooves 161 do not extend as far as the free end of the spike, which free end thus forms a complete annular periphery that serves as a leaktight seat, as described below. The body 1' also forms a cover 17' that is advantageously formed integrally with the remainder of the body. The cover 17' forms a leaktight closure pin 19'.

The slider 3' constitutes a movable member that is axially movable down and up against a spring 36' that bears against the body 1' at the bottom wall of the connection chamber 13'. The slider 3' is thus urged by the spring 36' against an abutment that defines the rest position of the movable member. By way of example, the abutment may be formed on a disk 35' that is guided axially inside the body 1'. In addition, the slider or movable member 3' defines a filling duct 31' having a top end that extends through a projecting connection stud 32' having a function that is to come into leaktight contact with a filling valve of a travel or refillable dispenser. The filling duct 31' is accessible from the top face of the head, when the cover 17' is open. The bottom end of the filling duct 31' is formed by a tube 34' that is engaged around the spike 16' that projects into the connection chamber 13'. In the rest position shown in FIG. 3, the tube 34' is in leaktight contact with the spike 16'. The slider or movable member 3' also includes a collar 33' called a channel lip elsewhere that extends coaxially around the tube 34'. In the rest position shown in FIG. 3, the collar 33' is positioned just above the inlet of the outlet channel 14' and thus does not close it. The cover 17' is closed in such a manner that its closure pin 19' penetrates in leaktight manner into the connection stud 32'. In this rest and dispensing configuration, the fluid delivered through the actuator rod S5 penetrates into the connection chamber 13', then flows through the outlet channel 14' so as to reach the nozzle 2' and its dispenser orifice. Communication to the filling duct 31' is closed off by the leaktight contact of the tube 34' with the spike 16'.

In FIG. 4, it can be seen that the cover 17' is open and that the slider or movable member 3' has been depressed against the spring 36'. The tube 34' is thus positioned at the axial groove 161 of the spike 16'. The leaktight contact between the tube 34' and the spike 16' is broken and fluid communication is established between the connection chamber 13' and the flow duct 31'. In addition, the collar 33' is now positioned facing the inlet of the outlet channel 14' and closes it in leaktight manner. Dispensing communication is thus interrupted between the chamber 13' and the outlet channel 14'. This can be seen more clearly in FIG. 5. This filling configuration makes it possible for the fluid delivered through the actuator rod S5 to pass through the connection chamber 13', to flow through the grooves 161 of the spike 16' so as to arrive in the filling duct 31', and from there through a filling valve of a refillable dispenser.

Figure 6:
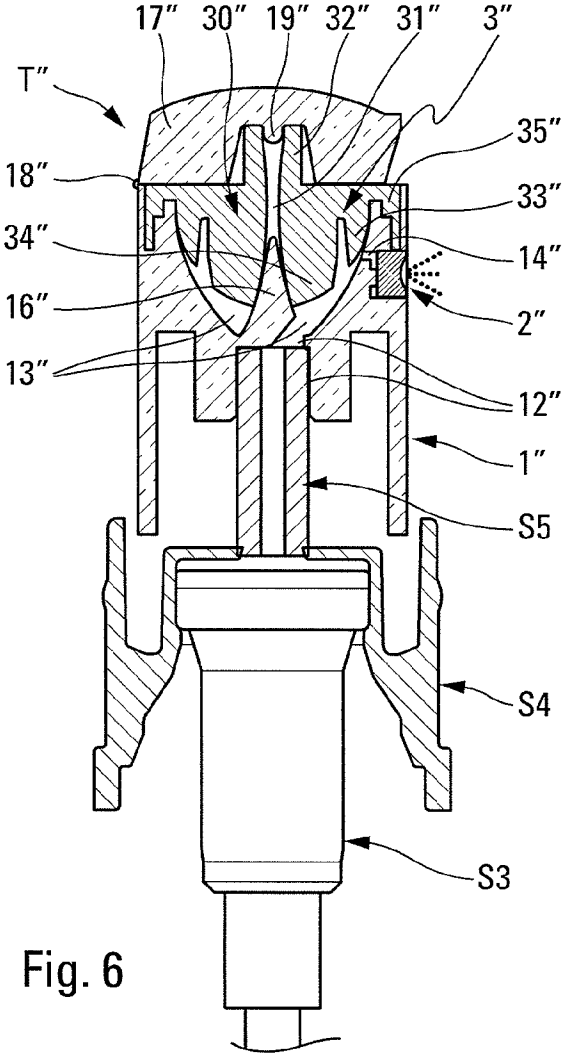
FIG. 6 is a view similar to FIGS. 1 and 3 in a third embodiment of the invention.

Reference is made below to FIG. 6 in order to describe the dispenser head T" in the third embodiment of the invention. The head T" comprises a body 1", a nozzle 2", and a stopper or movable member 3".

The body 1" defines an inlet duct 12" that communicates directly with a connection chamber 13" at the center of which there projects a spike 16". The chamber also communicates with an outlet duct 14" that leads to the nozzle 2" that forms a dispenser orifice through which the fluid is dispensed, e.g. in the form of spray.

The stopper or movable member 3" is made out of an elastically-deformable flexible material having shape memory. It includes an annular peripheral anchor band 35" that is in leaktight stationary engagement with the body 1". Inside the annular band 35", the stopper 3" forms a lip 33". Inside the lip 33", the stopper 3" forms a filling duct 31" having a top end that is surrounded by a connection stud 32" for coming to bear in leaktight manner against a filling valve of a refillable dispenser. The bottom end of the filling duct 31" is formed by a ring 34" that is engaged around the spike 16". In the dispensing configuration shown in FIG. 6, the lip 33" does not close the outlet channel 14" that leads to the nozzle 2". In addition, the ring 34" bears in leaktight manner around the spike 16", such that communication between the chamber 13" and the filling duct 31" is interrupted. Thus, by pressing on the cover 17" having a closure pin 19" that closes the outlet of the filling duct 31", the fluid coming from the actuator rod S5 passes through the chamber 13" and flows through the outlet channel 14" so as to reach the nozzle 2" from where it is sprayed.

Figure 7:
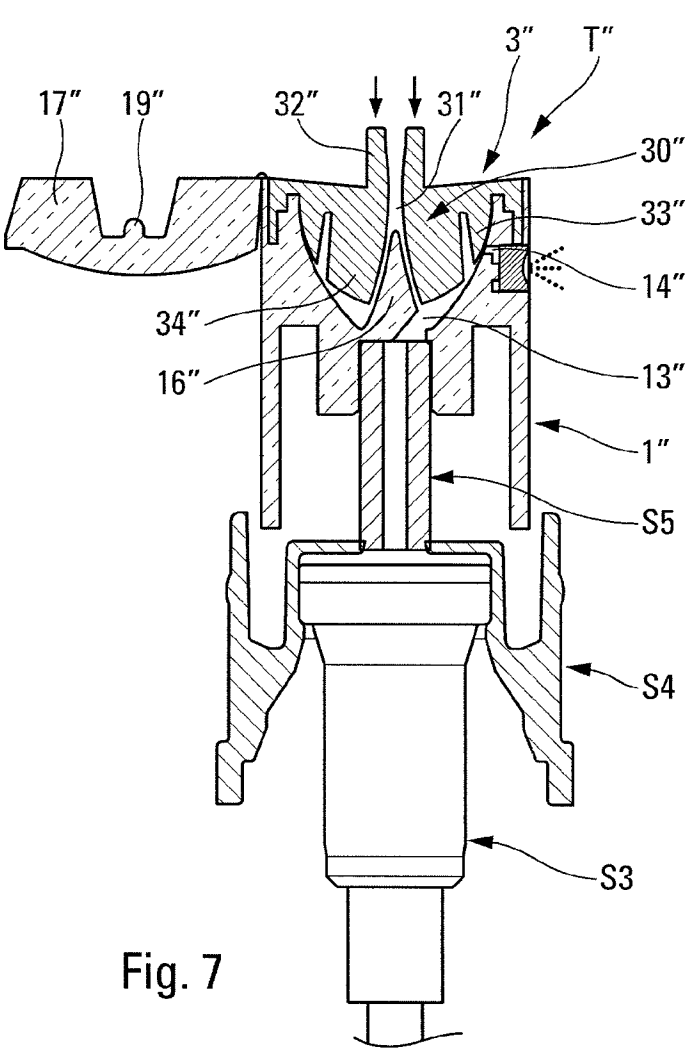
FIG. 7 is a view similar to FIG. 6 in the filling state.

With reference to FIG. 7, it can be seen that the cover 17" is open and that the stopper or movable member 3" has been subjected to elastic deformation caused by downward axial pressure. Deforming the stopper 3" causes the lip 33" to plug the inlet of the outlet channel 14" and to lift the ring 34" off from the spike 16". As a result, filling communication is established between the connection chamber 13" and the filling duct 31". Dispensing communication between the chamber 13" and the outlet channel 14" is interrupted. By way of example, the stopper 3" may be caused to deform by a filling valve in bearing contact against the connection stud 32".

In all three above-described embodiments, the dispenser head incorporates diversion or redirection or bypass means that interrupt dispensing communication between the connection chamber and the outlet channel that leads to the dispenser orifice, and that redirect the flow of fluid through a filling duct that may be connected to a filling valve of a refillable dispenser. All of the deviation or diversion means use a movable member that is either turnable, moves in translation, or is deformable, and that closes the outlet channel 14' and establishes communication with the outside through the filling duct. In the first embodiment in FIGS. 1 and 2, the cover 35 is necessary, whereas in the other two embodiments, the cover 17' and 17" is optional. The inlet and filling ducts are in alignment, but remote from each other, whereas the dispenser orifice preferably faces sideways.

By means of the invention, it is possible to fill a refillable dispenser from a source dispenser without having to remove the pusher from the source dispenser, and to do so in a manner that is very simple, since it suffices to press the refillable dispenser against the source dispenser.

The invention claimed is:

1. A fluid dispenser head including:

an inlet duct; and a dispenser orifice in dispensing communication with the inlet duct;

the dispenser head includes diversion means for selectively interrupting dispensing communication between the inlet duct and the dispenser orifice, and for establishing filling communication with a filling duct formed by the dispenser head and exiting outside the dispenser head through an opening different from the dispensing orifice.

2. The dispenser head according to claim 1, wherein the inlet duct is accessible from a bottom face of the head, the filling duct opens out on a top face of the head, remote from the inlet duct, and the dispenser orifice advantageously opens out on a side face of the head.

3. The dispenser head according to claim 1, including an outlet channel upstream from the dispenser orifice, and a connection chamber that connects the inlet duct to the outlet channel, the diversion means comprising a movable member that is arranged in the connection chamber for selectively closing the outlet channel.

4. The dispenser head according to claim 3, wherein the filling duct connects the connection chamber to the outside.

5. The dispenser head according to claim 3, wherein the movable member selectively closes the filling duct.

6. The dispenser head according to claim 3, wherein the movable member is axially movable.

7. The dispenser head according to claim 6, wherein the movable member includes a channel lip for selectively closing the outlet channel, and forms the filling duct that is engaged on a spike so as to close it selectively.

8. The dispenser head according to claim 3, wherein the movable member is elastically deformable.

9. The dispenser head according to claim 8, wherein the filling duct is radially deformable.

10. The dispenser head according to claim 3, wherein the movable member is movable in turning.

11. The dispenser head according to claim 10, wherein the movable member comprises a turnable actuator ring that is accessible on a side face of the head.

12. The dispenser head according to claim 1, wherein the filling duct opens out to the outside at a projecting connection stud for coming into contact with a filling valve of a refillable dispenser.

13. The dispenser head according to claim 1, further including a cover for closing the filling duct from the outside.

14. A dispenser assembly comprising:

a source dispenser including a fluid reservoir on which there is mounted a dispenser member provided with a dispenser head according to claim 1; and a refillable dispenser including a filling valve;

the filling duct being pressed against the filling valve in such a manner as to actuate the dispenser member of the source dispenser and to open the filling valve, such that the fluid coming from the source dispenser is transferred into the refillable dispenser.

15. The dispenser head according to claim 2, including an outlet channel upstream from the dispenser orifice, and a connection chamber that connects the inlet duct to the outlet channel, the diversion means comprising a movable member that is arranged in the connection chamber for selectively closing the outlet channel.

16. The dispenser assembly according to claim 14, wherein the dispenser member is a pump.

17. A fluid dispenser head, comprising:

an inlet duct for receiving fluid from a fluid reservoir;

a first dispenser opening selectively in communication with the inlet duct and for dispensing the fluid from the dispenser head;

a second dispenser opening selectively in communication with the inlet duct and for dispensing the fluid from the dispenser head;

wherein, when the first dispenser opening is in communication with the inlet duct for dispensing the fluid from the dispenser head, the second dispenser opening is blocked from dispensing fluid form the dispenser head; and wherein, when the second dispenser opening is in communication with the inlet duct for dispensing the fluid from the dispenser head, the first dispenser opening is blocked from dispensing fluid form the dispenser head.

18. The fluid dispenser head according to claim 17, wherein the dispenser head is actuated by moving at least a portion of the dispenser head axially along an axis, wherein the first dispenser opening faces a radial direction relative to the axis so as to dispense fluid along the radial direction, and wherein the second dispenser opening faces a direction parallel to the axis so as to dispense fluid along the axial direction.

19. The fluid dispenser head according to claim 17, comprising means for selectively closing off fluid communication between the inlet duct and each of the first dispenser opening and the second dispenser opening.

* * * * *